US006842595B1

(12) United States Patent
McIver et al.

(10) Patent No.: US 6,842,595 B1
(45) Date of Patent: Jan. 11, 2005

(54) MULTI-LEVEL SEAL

(75) Inventors: Jetara McIver, Sanford, NC (US); Fred McIntosh, Sanford, NC (US); James Jones, Fayetteville, NC (US); Azhar Raina, Raleigh, NC (US)

(73) Assignee: Static Control Components, Inc., Sanford, NC (US)

( * ) Notice: Subject to any disclaimer, the term of this patent is extended or adjusted under 35 U.S.C. 154(b) by 0 days.

(21) Appl. No.: 10/605,813

(22) Filed: Oct. 29, 2003

(51) Int. Cl.[7] ..... G03G 15/08

(52) U.S. Cl. ..... 399/106; 222/DIG. 1; 399/98; 399/103

(58) Field of Search ..... 399/106, 102, 399/103, 105, 98, 99, 109; 156/277, 308.04, 384; 222/DIG. 1

(56) References Cited

U.S. PATENT DOCUMENTS

| | | | | |
|---|---|---|---|---|
| 4,615,608 A | | 10/1986 | Mizutani | |
| 4,732,277 A | | 3/1988 | Smith | |
| 4,862,210 A | | 8/1989 | Woolley | |
| 4,930,684 A | | 6/1990 | Patterson | |
| 4,931,838 A | | 6/1990 | Ban | |
| 4,981,218 A | | 1/1991 | Ban | |
| 5,080,745 A | | 1/1992 | Paull | |
| 5,110,646 A | | 5/1992 | Prestel | |
| 5,150,807 A | | 9/1992 | Seyfried | |
| 5,184,182 A | | 2/1993 | Michlin | |
| 5,282,003 A | | 1/1994 | Michlin | |
| 5,296,902 A | | 3/1994 | Michlin | |
| 5,337,126 A | | 8/1994 | Michlin | |
| 5,404,212 A | | 4/1995 | Ditomaso | |
| 5,455,665 A | * | 10/1995 | Baba et al. | 399/99 X |
| 5,502,547 A | * | 3/1996 | Shirai | 399/102 |
| 5,523,828 A | | 6/1996 | De Kesel | |
| 5,621,508 A | | 4/1997 | McNamara | |
| RE35,529 E | | 6/1997 | Michlin | |
| 5,650,841 A | | 7/1997 | Matsuda | |
| 5,724,631 A | | 3/1998 | Nakao | |
| 5,749,026 A | | 5/1998 | Goldie | |
| 5,878,306 A | | 3/1999 | Michlin | |
| 5,930,559 A | | 7/1999 | De Kesel | |
| 6,009,287 A | | 12/1999 | Goldie | |
| 6,041,202 A | | 3/2000 | Cornelius | |
| 6,044,238 A | | 3/2000 | Rodriguez | |
| RE36,920 E | | 10/2000 | De Kesel | |
| 6,137,970 A | | 10/2000 | Sasago | |
| 6,341,206 B1 | | 1/2002 | Yamaguchi | |
| 6,350,503 B1 | | 2/2002 | Cheatham | |
| 6,356,724 B1 | | 3/2002 | Michlin | |
| 6,445,893 B2 | | 9/2002 | Hashimoto | |
| 6,487,383 B2 | * | 11/2002 | Buchanan et al. | 399/103 |
| 6,512,903 B2 | | 1/2003 | Chadani | |
| 6,539,187 B2 | | 3/2003 | De Kesel | |
| 6,552,780 B1 | | 4/2003 | Michlin | |
| 6,574,445 B2 | | 6/2003 | Higeta | |
| 6,577,829 B2 | | 6/2003 | Higeta | |

FOREIGN PATENT DOCUMENTS

| | | |
|---|---|---|
| GB | 2289238 | 11/1995 |

* cited by examiner

*Primary Examiner*—Sophia S. Chen

(57) ABSTRACT

A multi-level seal may include a first sealing portion adapted to form a first seal between interfacing surfaces of a first subassembly and a second subassembly. The multi-level seal may include at least one other sealing portion attached to the first sealing portion and partially detached from the first sealing portion to form at least a second seal between at least two other respective interfacing surfaces of the first and second subassemblies at a level different from the first seal.

45 Claims, 3 Drawing Sheets

MULTI-LEVEL SEAL

BACKGROUND OF INVENTION

The present invention relates to seals, gaskets and the like, and more particularly to a multi-level seal or gasket to retain or seal toner in a printer cartridge or the like.

Sealing subassemblies with multiple interfacing surfaces that are at different elevations, levels or topologies can be challenging. This problem can be exacerbated when the multiple elevations or levels are concentric and require proper alignment and cooperation to form efficient seals. One example of sealing multiple surfaces with differing levels and topologies is a printer cartridge. The seal must prevent leakage of toner and not interfere with proper operation of internal components of the cartridge. Difficulty in sealing a cartridge increases when multiple contoured surfaces and geometries are introduced at different levels between components or subassemblies, such as a magnetic or mag roller subassembly and a tone hopper subassembly. In some cartridges, the toner low sensing mechanism may obstruct the seal from lying flat against the sealing surface of the magnetic roller subassembly. Multiple plane geometries in the sealing interface areas or surfaces can produce voids prohibiting the seal from sealing properly. On the toner hopper assembly, changing topologies or levels between upper and lower sealing surfaces also increases sealing difficulty. The height difference between the two surfaces is important because the toner low sensing mechanism must be positioned between the upper and lower sealing surfaces of the hopper subassembly after final assembly of the two subassemblies. The presence of a seal or portion of the seal between the toner low sensing mechanism and the toner could interfere with a proper toner low indication. Additionally, the seal should not over hang or extend over a lower sealing surface and partially protrude into the toner hopper because toner may become trapped underneath the seal. Trapping some toner could reduce the number of pages printable by restricting the toner from being introduced to the magnetic roller. Further, sealing problems may occur when exit geometries from the lower sealing surface to the outside of the cartridge produce leak paths.

SUMMARY OF INVENTION

In accordance with an embodiment of the present invention, a multi-level seal or gasket may include a first sealing portion adapted to form a first seal between interfacing surfaces of a first subassembly and a second subassembly. The multi-level seal or gasket may also include at least one other sealing portion attached to the first sealing portion and partially detached from the first sealing portion to form at least a second seal. The second seal being formed between at least two other respective interfacing surfaces of the first and second subassemblies at a level different from the first seal.

In accordance with another embodiment of the present invention, a multi-level seal or gasket may include a layer of material and a plurality of slits, cuts or openings formed through the layer of material to form a plurality of sealing portions. Each sealing portion may be adapted to form a seal at different levels, elevations or topologies within an assembly.

In accordance with another embodiment of the present invention, a printer cartridge may include a first cartridge subassembly and a second cartridge subassembly. A multi-level seal or gasket may be disposed between the first cartridge subassembly and the second cartridge subassembly. The multi-level seal or gasket may include a first sealing portion adapted to form a first seal between interfacing surfaces of the first cartridge subassembly and the second cartridge subassembly. The multi-level seal or gasket may also include at least one other sealing portion attached to the first sealing portion and partially detached from the first sealing portion to form at least a second seal. The second seal being formed between at least two other respective interfacing surfaces of the first and second cartridge subassemblies at a level different from the first seal.

In accordance with another embodiment of the present invention, a method of making a multi-level seal or gasket may include forming a first sealing portion adapted to form a first seal between interfacing surfaces of a first subassembly and a second subassembly. The method may also include forming at least one other sealing portion attached to the first sealing portion and partially detached from the first sealing portion to form at least a second seal. The second seal being formed between at least two other respective interfacing surfaces of the first and second subassemblies at a level different from the first seal.

In accordance with another embodiment of the present invention, a method of making or refurbishing a printer cartridge may include providing a first cartridge subassembly and providing a second cartridge subassembly. The method may further include disposing a multi-level seal or gasket between the first cartridge subassembly and the second cartridge subassembly. The multi-level seal or gasket may be formed by a method including forming a first sealing portion adapted to form a first seal between interfacing surfaces of the first cartridge subassembly and the second cartridge subassembly. The method of forming the multi-level seal may also include forming at least one other sealing portion attached to the first sealing portion and partially detached from the first sealing portion to form at least a second seal. The second seal being formed between at least two other respective interfacing surfaces of the first and second cartridge subassemblies at a level different from the first seal.

DETAILED DESCRIPTION

The following detailed description of preferred embodiments refers to the accompanying drawings which illustrate specific embodiments of the invention. Other embodiments having different structures and operations do not depart from the scope of the present invention.

Figure 1:
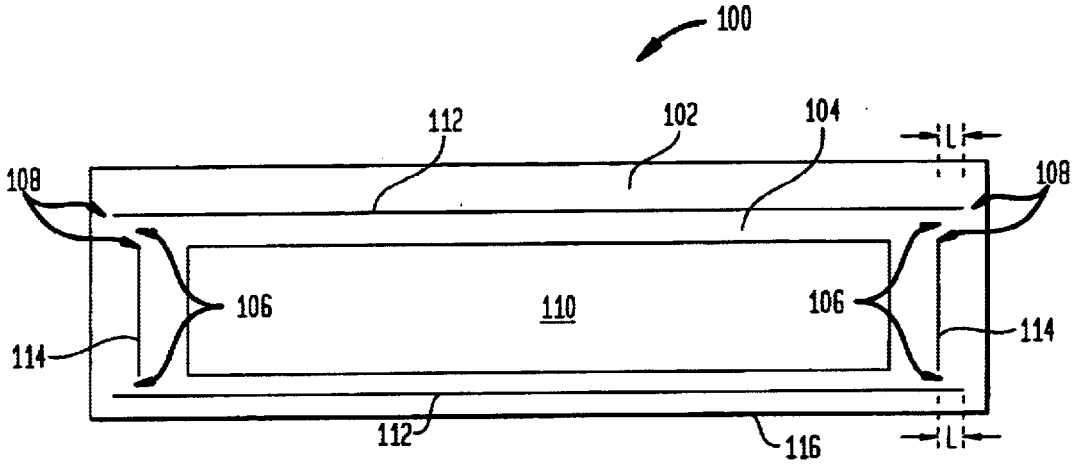
FIG. 1 is a top view of a multi-level seal or gasket in accordance with an embodiment of the present invention.

FIG. 1 is a top view of a multi-level seal 100 or gasket in accordance with an embodiment of the present invention.

The multi-level seal 100 may include a first sealing portion 102 adapted to form a first seal between interfacing surfaces of a first subassembly and a second subassembly. The multi-level seal 100 may also include at least one other sealing portion 104 attached to the first sealing portion and partially detachable from the first sealing portion 102 to form at least a second seal. The second seal may be formed between at least two respective interfacing surfaces of the first and second subassemblies at a level different from the first seal as will be described in more detail with reference to an example application of a multi-level seal in FIG. 3. The at least one other sealing portion 104 may be concentric with the first sealing portion 102 and may be attached to the first sealing portion 102 at a plurality of attachment points 1.06 at predetermined locations. The first sealing portion 102 and the at least one other sealing portion 104 may each form a substantially rectangular shaped boundary as shown in FIG. 1. Alternatively, the first sealing portion 102 and the at least one other sealing portion may form any shaped boundary depending upon the application and the configuration of the interfacing surfaces between which the multi-level seal 100 may be disposed.

The multi-level seal 100 may be formed from a single layer of material. The layer of material may be deformable, elastic or stretchable material, such as a closed cell foam, a latex or other elastic, nonporous type material. A plurality of slits 108, opening or cuts may be formed through the material to form or define the first sealing portion 102 and the at least one other sealing portion 104. A center opening 110 may be formed in the multi-level seal 100 such as for use in a printer cartridge or the like as will be described with reference to FIG. 3. The plurality of slits 108 may include a first pair 112 of substantially parallel slits and a second pair 114 of substantially parallel slits. The second pair 114 of slits may be substantially perpendicular to the first pair 112 of slits and nonintersecting with the first pair 112 of slits to integrally form each the plurality of attachment points 106. The first and second pairs 112 and 114 of slits may be formed or cut to form each of the first sealing portion 102 and second sealing portion 104 in a substantially rectangular or square shaped boundary 116. Alternatively, the plurality of slits 108 may be formed in any selected pattern depending upon the design or geometry of the multi-level interfacing surfaces to which the multi-level seal 100 may be applied.

Figure 3:
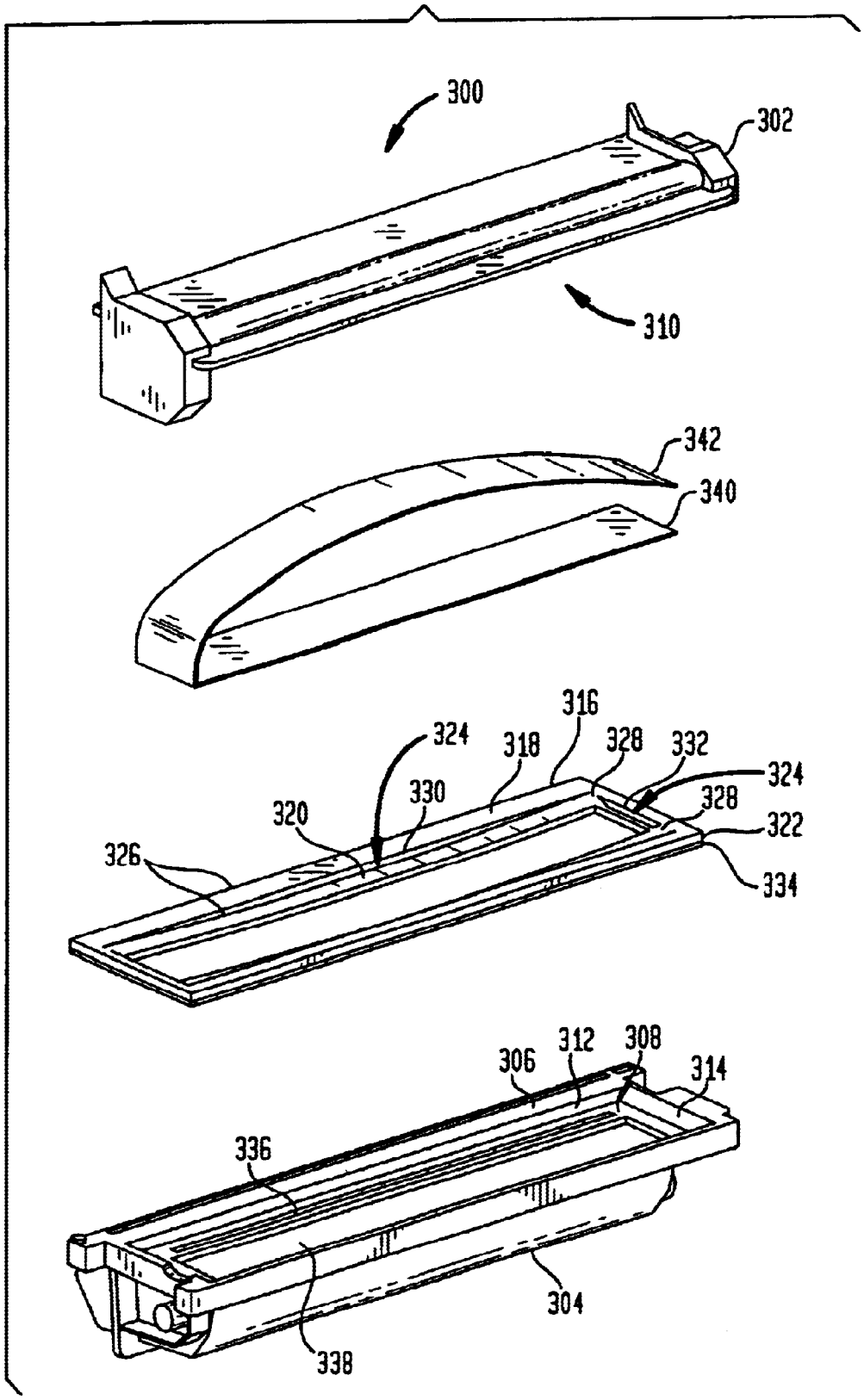
FIG. 3 is an exploded view of an example of an unassembled printer cartridge in accordance with an embodiment of the present invention.

In accordance with one embodiment of the present invention, the first pair 112 of slits may extend a predetermined distance or length "L" past or beyond the second pair 114 of slits to facilitate the first sealing portion 102 and the at least one other sealing portion 104 forming seals between respective interfacing surfaces on different levels or elevations of an assembly, such as the assembly or printer cartridge 300 of FIG. 3. The predetermined length "L" may be a function of or determined by the difference in level or elevation between a first seal formable by the first sealing portion 102 and at least a second seal 104 formable by the at least one other sealing portion 104 in the assembly.

Figure 2:
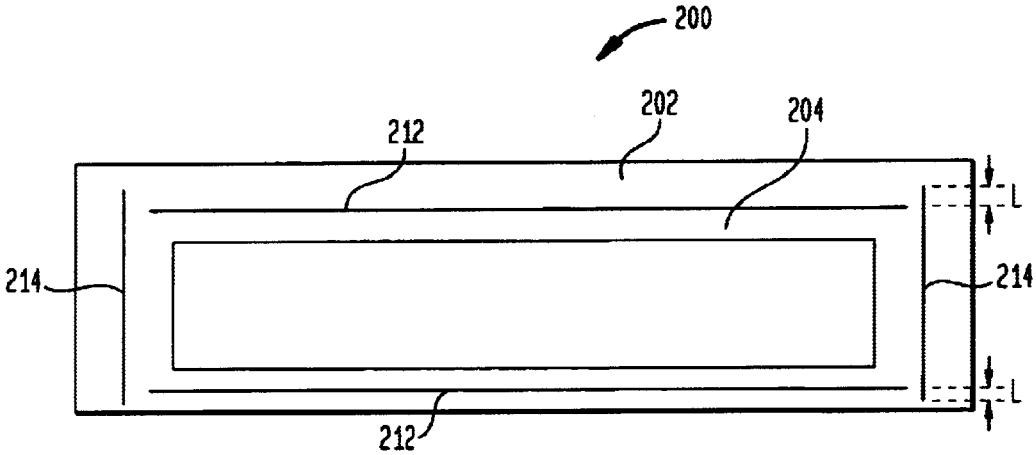
FIG. 2 is a top view of a multi-level seal or gasket in accordance with another embodiment of the present invention.

In accordance with another embodiment of the present invention shown in FIG. 2, a multi-level seal 200 or gasket may include a second pair 214 of slits extending a predetermined distance or length "L" past or beyond a first pair 212 of slits to facilitate a first sealing portion 202 and at least one other sealing portion 204 forming seals at different levels or elevation of an assembly. Similar to the seal 100 in FIG. 1, the predetermined length "L" may be determined by the difference in level or elevation between the interfacing surfaces of an assembly where the multi-level seal 200 may be applied.

An example of an application of a multi-level seal or gasket, such as the multi-level seal or gasket 100 or 200 of FIGS. 1 and 2, respectively, is shown in FIG. 3.

FIG. 3 is an exploded view of an example of an unassembled printer cartridge 300 in accordance with an embodiment of the present invention. The printer cartridge 300 includes a magnetic roller subassembly 302, also known as a mag roller subassembly, and a toner hopper subassembly 304. Each of the magnetic roller subassembly 302 and the toner hopper subassembly 304 may have interfacing surfaces that abut or interface at different levels or elevations when the two subassemblies 302 and 304 are assembled to form the completed printer cartridge 300. As best shown on the toner cartridge subassembly 304, the subassembly 304 may have a first interfacing surface 306 and a recessed second interfacing surface 308 at a different level or elevation from the first surface 306. Each of the first and second interfacing surfaces 306 and 308 will abut mating interfacing surfaces (not shown in FIG. 3) formed in a under side 310 of the magnetic roller subassembly 302. The interfacing surfaces 306 and 308 may be joined by substantially vertical side walls 312 and substantially vertical or slanted end walls 314. In some designs, both the side walls 312 and end walls 314 may be substantially vertical or slanted or inclined a predetermined slope. Both of the interfacing surfaces 306 and 308 are preferably sealed to prevent toner material from leaking from the toner hopper subassembly 304. To prevent leakage of toner, a multi-level seal 316 or gasket may be disposed between the magnetic roller subassembly 302 and the toner hopper subassembly 304 when the printer cartridge 300 is assembled. The multi-level seal 316 may be similar to the multi-level seals 100 and 200 described with respect to FIGS. 1 and 2. The multi-level seal 316 may include a first sealing portion 318 to contact the first interfacing surface 306 of the toner hopper subassembly 304 and a second sealing portion 320 to contact the recessed interfacing surface 308. The multi-level seal 316 may be formed from a single layer 322 of material. The material may be a closed cell foam, latex or other deformable or elastic, nonporous type material with characteristics to keep the fine toner material within the cartridge 300 and moisture out. The material may also be an open cell foam or porous if compression is sufficient to close the cell structure when the subassemblies 302 and 304 are assembled to form the printer cartridge 300 and to substantially keep the toner in and moisture out. The material may be stretchable, elastic and deformable to facilitate forming an efficient seal at different levels between the two subassemblies 302 and 304.

The first sealing portion 318 and the second sealing portion 320 may be formed by cutting or forming a plurality of slits 324 in the layer 322. The slits 324 may be cut in a selected pattern such that the first and second sealing portions 318 and 320 are concentric and form substantially rectangular shaped boundaries 326. The slits 324 may also be cut to integrally form a plurality of attachment points 328 to attach the first sealing portion 318 to the second sealing portion 320. The attachment points 328 may be proximate to the corners of the substantially rectangular boundaries 326. The attachment points 328 may facilitate proper alignment between the first and second sealing portions 318 and 320 and the first and second interfacing surfaces 306 and 308.

Similar to that discussed with respect to FIGS. 1 and 2, the plurality of slits 324 may include a first pair 330 of substantially parallel slits and a second pair 332 of substantially parallel slits. The first pair 330 of slits may extend a predetermined length beyond the second pair 332 of slits to facilitate the first and second sealing portions 318 and 320 forming seals at different levels or elevations.

The multi-level seal 316 may also include at least a second layer 334 of material that may be an adhesive, such as a pressure sensitive adhesive or the like. The adhesive layer 334 may facilitate positioning and retaining the first and second sealing portions 318 and 320 in place on the respective interfacing surfaces 306 and 308 of the toner hopper subassembly 304 or alternatively on the magnetic roller assembly 302. The adhesive layer 334 may also hold the second sealing portion 320 in position to prevent the layer 322 from interfering with a conductive strip 336 that forms a portion of the toner level sensing mechanism integral to the magnetic roller subassembly 302 when the magnetic roller subassembly 302 and toner hopper subassembly 304 are joined together to form the printer cartridge 300. The adhesive layer 334 may further prevent the second sealing portion 320 from extending over the recessed second interfacing surface 308 and partially protruding into an opening 338 of the toner hopper subassembly 304. Thus, preventing toner from possibly becoming trapped underneath the seal 316.

The printer cartridge 300 may also include a pull film 340 that may be disposed between the multi-level seal 316 and the mag roller subassembly 320 during assembly. The pull film 340 is designed to seal the toner in the toner hopper subassembly 304 during transit and prior to an end user installing the cartridge 300 in a printer. The pull film 340 may be folded back on itself as shown in FIG. 3 with an end 342 extending outside of an end of the cartridge 300 after assembly. The end 342 of the film 3.40 is adapted for an end user to grip the end 342 and pull the film 340 to remove the film 340 and permit toner to communicate between the toner hopper subassembly 304 and the magnetic roller subassembly 302 for printing. The adhesive layer 334 on the multi-level seal 316 may also prevent the seal 316 from shifting or bunching during removal of the pull film 340 to prevent toner leakage.

Figure 4:
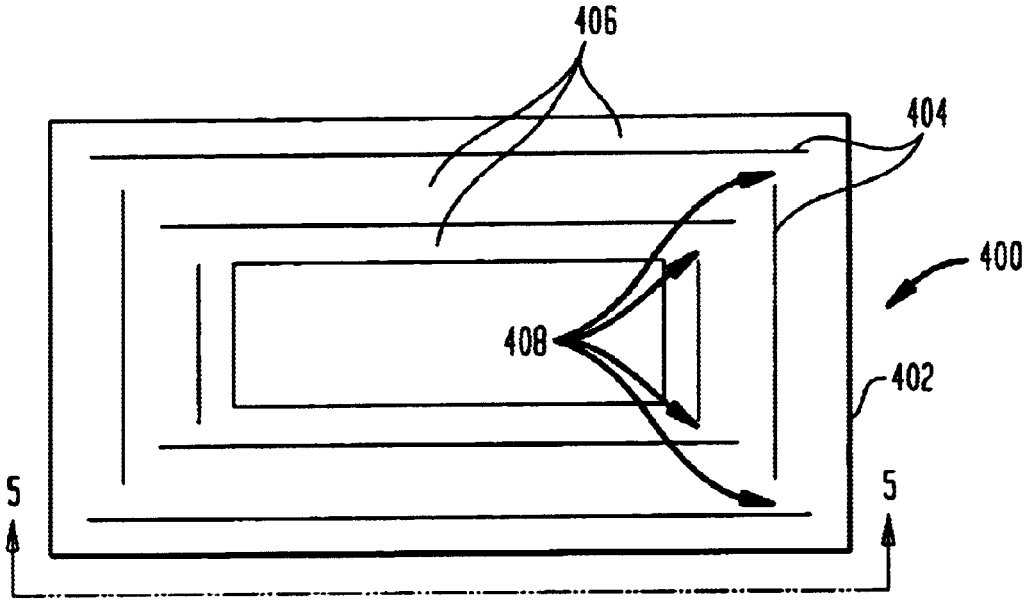
FIG. 4 is a top view of a multi-level seal or gasket in accordance with another embodiment of the present invention.

FIG. 4 is a top view of a multi-level seal 400 or gasket in accordance with another embodiment of the present invention. The multi-level seal 400 may be formed from a single layer 402 of material. The material may be a closed cell foam, latex or other deformable, elastic and non-porous type material. As previously discussed, the material may also be an open cell foam, porous type material or the like if compression on the multi-level seal 400 is sufficient to close the cell structure when the seal 400 is in use. A plurality of openings or slits 404 may be formed or cut therein to form multiple sealing portions 406. Each of the multiple sealing portions 406 may be adapted to form a seal at different levels or elevations within an assembly, such as the printer cartridge 300 of FIG. 3 or the like. The plurality of slits 404 may be formed in a selected pattern to form the multiple sealing portions 406 according to the design or geometry of the structure or assembly in which the multi-level seal 400 may be used. The sealing portions 406 may be concentric and each form a boundary having a predetermined shape. While the pattern of the slits 404 in FIG. 4 are shown to be substantially parallel and perpendicular to each other to form the multiple sealing portions 406 in substantially rectangular shaped boundaries, the sealing portions may be formed in other predetermined geometric shapes as well depending upon the desired need. For example the predetermined shape of the sealing portions 406 may be substantially circular, elliptical, multisided or the like.

The plurality of slits 404 may be nonintersecting to integrally form attachment points 408 at predetermined locations to attach each sealing portion 406 to an adjacent sealing portion 406. The plurality of slits 404 may also include pairs of slits extending in one direction that extend a predetermined length past or beyond associated pairs of slits extending in another direction to define each sealing portion 406. The extended predetermined length may facilitate the different sealing portions 406 forming seals at different levels or elevations within an assembly as previously described. The predetermined length may be determined by the difference in level between each seal formed by each of the plurality of sealing portions 406.

Figure 5:
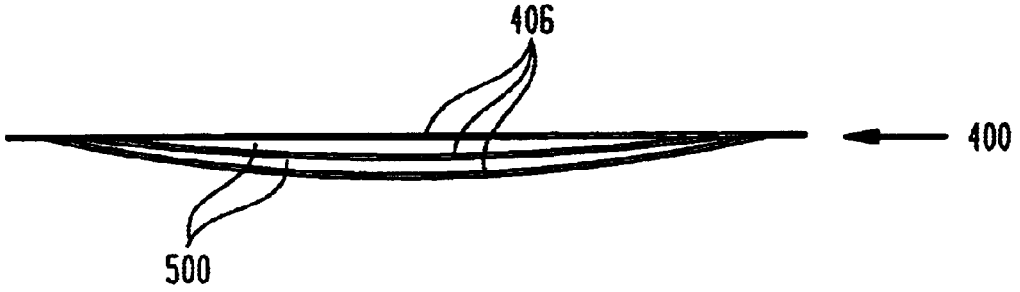
FIG. 5 is a side elevation view of the multi-level seal or gasket of FIG. 4 taken along lines 5—5.

FIG. 5 is a side elevation view of the multi-level seal 400 or gasket of FIG. 4 taken along lines 5—5. As shown in FIG. 5, the each of the multiple sealing portions 406 may extend accordion-like to accommodate forming seals at different levels of interfacing surfaces of an assembly. A window 500 may be formed or defined by a spacing between each of the sealing portions 406. The multi-level seal 400 may also include a second layer of material (not shown) that may be a adhesive layer to facilitate retaining the multi-level seal 400 in place on surfaces with differing topologies.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

What is claimed is:

1. A multi-level seal, comprising:

a first sealing portion adapted to form a first seal between interfacing surfaces of a first subassembly and a second subassembly; and at least one other sealing portion attached to the first sealing portion and partially detached from the first sealing portion by a plurality of slits to form at least a second seal between at least two other respective interfacing surfaces of the first and second subassemblies at a level different from the first seal.

2. The multi-level seal of claim 1, further comprising a plurality of attachment points to attach the at least one other sealing portion to the first sealing portion at predetermined locations.

3. The multi-level seal of claim 1, wherein the first sealing portion and the at least one other sealing portion are formed from a single layer of a deformable material.

4. The multi-level seal of claim 1, wherein the first sealing portion and the at least one other sealing portion are formed from a single layer of at least one of a cell structured foam, latex or other elastic type material.

5. The multi-level seal of claim 1, wherein the first and second subassemblies form a printer cartridge when assembled with the multi-level seal disposed therebetween to prevent leakage of toner at multiple interfacing surfaces at different levels between the first and second subassemblies.

6. A multi-level seal, comprising:

a first sealing portion adapted to form a first seal between interfacing surfaces of a first subassembly and a second subassembly; and at least one other sealing portion attached to the first sealing portion and partially detached from the first sealing portion to form at least a second seal between at least two other respective interfacing surfaces of the first and second subassemblies at a level different from the first seal, wherein the at least one other sealing portion is concentric with the first sealing portion and is attached at predetermined locations to the first sealing portion.

7. A multi-level seal, comprising:

a first sealing portion adapted to form a first seal between interfacing surfaces of a first subassembly and a second subassembly; and at least one other sealing portion attached to the first sealing portion and partially detached from the first sealing portion to form at least a second seal between at least two other respective interfacing surfaces of the first and second subassemblies at a level different from the first seal, wherein the first sealing portion and the at least one other sealing portion are concentric and each form a substantially rectangular shaped boundary.

8. The multi-level seal of claim 7, wherein the at least one other sealing portion is joined to the first sealing portion proximate to each corner of the substantially rectangular shaped boundary of the at least one other sealing portion.

9. A multi-level seal, comprising:

a first sealing portion adapted to form a first seal between interfacing surfaces of a first subassembly and a second subassembly;

at least one other sealing portion attached to the first sealing portion and partially detached from the first sealing portion to form at least a second seal between at least two other respective interfacing surfaces of the first and second subassemblies at a level different from the first seal;

single layer of material; and a plurality of slits formed through the single layer of material to form the first sealing portion and the at least one other sealing portion.

10. The multi-level seal of claim 9, wherein the first sealing portion is concentric with the at least one other sealing portion and each form a substantially rectangular shaped boundary, and wherein the plurality of slits comprise:

a first pair of substantially parallel slits; and a second pair of substantially parallel slits, each substantially perpendicular to the first pair of slits and nonintersecting with the first pair of slits.

11. The multi-level seal of claim 10, wherein each of the first pair of slits extends a predetermined length past each of the second pair of slits.

12. The multi-level seal of claim 11, wherein the predetermined length is a function of the difference in level between the first seal and the at least one second seal.

13. A multi-level seal, comprising:

a layer of material; and a plurality of slits formed through the layer of material to form a plurality of sealing portions, each sealing portion being adapted to form a seal at different levels within an assembly.

14. The multi-level seal of claim 13, further comprising a plurality of integrally formed attachment points to attach each sealing portion to an adjacent sealing portion at predetermined locations.

15. The multi-level seal of claim 13, wherein each of the sealing portions are concentric and are attached to adjacent sealing portions at predetermined locations.

16. The multi-level seal of claim 13, wherein each of the sealing portions form a boundary having a predetermined shape.

17. The multi-level seal of claim 16, wherein the predetermined shape is one of a substantially circular shape, a substantially elliptical shape and a multisided shape.

18. The multi-level seal of claim 13, wherein the layer of material comprises one of a cell structured foam, a latex or other elastic type material.

19. The multi-level seal of claim 13, further comprising another layer of material.

20. The multi-level seal of claim 19, wherein the other layer of material is an adhesive.

21. The multi-level seal of claim 13, wherein the plurality of slits comprise:

a first pair of substantially parallel slits to form a first pair of opposite sides of each sealing portion; and a second pair of substantially parallel slits to form a second pair of opposite sides of each sealing portion, wherein the second pair of slits are substantially perpendicular to the first pair of slits and nonintersecting with the first pair of slits.

22. The multi-level seal of claim 21, wherein each of the second pair of slits extends a predetermined length past each of the first pair of slits for each sealing portion.

23. The multi-level seal of claim 22, wherein the predetermined length of the second pair of slits extending past the first pair of slits for each sealing portion is a function of the difference in level between each seal formed by the plurality of sealing portions.

24. The multi-level seal of claim 13, wherein the assembly comprises a printer cartridge.

25. A printer cartridge, comprising:

a first cartridge subassembly;

a second cartridge subassembly; and a multi-level seal disposed between the first cartridge subassembly and the second cartridge subassembly, the multi-level seal including:

a first sealing portion adapted to form a first seal between interfacing surfaces of the first cartridge subassembly and the second cartridge subassembly, and at least one other sealing portion attached to the first sealing portion and partially detached from the first sealing portion by a plurality of slits to form at least a second seal between at least two other respective interfacing surfaces of the first and second cartridge subassemblies at a level different from the first seal.

26. The printer cartridge of claim 25, wherein the first sealing portion and the at least one other sealing portion are formed from a single layer of at least one of a cell structured foam, latex or other elastic type material.

27. A printer cartridge, comprising:

a first cartridge subassembly;

a second cartridge subassembly; and a multi-level seal disposed between the first cartridge subassembly and the second cartridge subassembly, the multi-level seal including:

a first sealing portion adapted to form a first seal between interfacing surfaces of the first cartridge subassembly and the second cartridge subassembly, and at least one other sealing portion attached to the first sealing portion and partially detached from the first sealing portion to form at least a second seal between at least two other respective interfacing surfaces of the first and second cartridge subassemblies at a level different from the first seal, wherein the at least one other sealing portion is concentric with the first sealing portion and is attached at predetermined locations to the first sealing portion.

28. A printer cartridge, comprising:

a first cartridge subassembly;

a second cartridge subassembly; and a multi-level seal disposed between the first cartridge subassembly and the second cartridge subassembly, the multi-level seal including:

a first sealing portion adapted to form a first seal between interfacing surfaces of the first cartridge subassembly and the second cartridge subassembly, and at least one other sealing portion attached to the first sealing portion and partially detached from the first sealing portion to form at least a second seal between at least two other respective interfacing surfaces of the first and second cartridge subassemblies at a level different from the first seal, wherein the first sealing portion and the at least one other sealing portion are concentric and each form a substantially rectangular shaped boundary.

29. The printer cartridge of claim 28, wherein the at least one other sealing portion is joined to the first sealing portion proximate to each corner of the substantially rectangular shaped boundary of the at least one other sealing portion.

30. A printer cartridge, comprising:

a first cartridge subassembly;

a second cartridge subassembly; and a multi-level seal disposed between the first cartridge subassembly and the second cartridge subassembly, the multi-level seal including:

a first sealing portion adapted to form a first seal between interfacing surfaces of the first cartridge subassembly and the second cartridge subassembly, and at least one other sealing portion attached to the first sealing portion and partially detached from the first sealing portion to form at least a second seal between at least two other respective interfacing surfaces of the first and second cartridge subassemblies at a level different from the first seal, wherein the multi-level seal further comprises:

a layer of material; and a plurality of slits formed through the layer of material to form the first sealing portion and the at least one other sealing portion.

31. The printer cartridge of claim 30, wherein the first sealing portion is concentric with the at least one other sealing portion and each form a substantially rectangular shaped boundary, and wherein the plurality of slits comprise:

a first pair of substantially parallel slits; and a second pair of substantially parallel slits, each substantially perpendicular to the first pair of slits and nonintersecting with the first pair of slits.

32. The printer cartridge of claim 31, wherein each of the second pair of slits extends a predetermined length past the first pair of slits.

33. The printer cartridge of claim 32, wherein the predetermined length of the second pair of slits extending past the first pair of slits is a function of the difference in level between the first seal and the at least one second seal.

34. A method of making a multi-level seal, comprising:

forming a first sealing portion adapted to form a first seal between interfacing surfaces of a first subassembly and a second subassembly; and forming at least one other sealing portion attached to the first sealing portion and partially detached from the first sealing portion by a plurality of slits to form at least a second seal between at least two other respective interfacing surfaces of the first and second subassemblies at a level different from the first seal.

35. The method of claim 34, further comprising forming the at least one other sealing portion and the first sealing portion attached to one another at predetermined locations.

36. The method of claim 34, further comprising forming the first sealing portion and the at least one other sealing portion from a layer of at least one of a cell structured foam, latex or other elastic type material.

37. A method of making a multi-level seal, comprising:

forming a first sealing portion adapted to form a first seal between interfacing surfaces of a first subassembly and a second subassembly;

forming at least one other sealing portion attached to the first sealing portion and partially detached from the first sealing portion to form at least a second seal between at least two other respective interfacing surfaces of the first and second subassemblies at a level different from the first seal;

forming the first sealing portion and the at least one other sealing portion from a layer of at least one of a cell structured foam, latex or other elastic type material; and forming a plurality of slits in the layer to form the first sealing portion and the at least one other sealing portion.

38. The method of claim 37, further comprising forming the first sealing portion concentric with the at least one other sealing portion and each in a substantially rectangular shaped boundary, and wherein forming the plurality of slits includes:

forming a first pair of substantially parallel slits; and forming a second pair of substantially parallel slits, each substantially perpendicular to the first pair of slits and nonintersecting with the first pair of slits.

39. The method of claim 37, further comprising forming each of the second pair of slits to extend a predetermined length past each of the first pair of slits.

40. The method of claim 39, further comprising forming the predetermined length to accommodate a difference in level between the first seal and the at least one other seal.

41. A method of making or refurbishing a printer cartridge, comprising:

providing a first cartridge subassembly;

providing a second cartridge subassembly; and disposing a multi-level seal between the first cartridge subassembly and the second cartridge subassembly, wherein the multi-level seal being formed by a method including:

forming a first sealing portion adapted to form a first seal between interfacing surfaces of the first cartridge subassembly and the second cartridge subassembly, and forming at least one other sealing portion attached to the first sealing portion and partially detached from the first sealing portion by a plurality of slits to form at least a second seal between at least two other respective interfacing surfaces of the first and second cartridge subassemblies at a level different from the first seal.

42. A method of making or refurbishing a printer cartridge, comprising:

providing a first cartridge subassembly;

providing a second cartridge subassembly; and disposing a multi-level seal between the first cartridge subassembly and the second cartridge subassembly, wherein the multi-level seal being formed by a method including:

forming a first sealing portion adapted to form a first seal between interfacing surfaces of the first cartridge subassembly and the second cartridge subassembly, and forming at least one other sealing portion attached to the first sealing portion and partially detached from the first sealing portion to form at least a second seal between at least two other respective interfacing surfaces of the first and second cartridge subassemblies at a level different from the first seal;

providing a layer of material; and forming a plurality of slits through the material to form the first sealing portion and the at least one other sealing portion.

43. The method of claim 42, further comprising:

forming the first sealing portion concentric to the at least one other sealing portion and each forming a substantially rectangular boundary, and wherein forming the plurality of slits includes:

forming a first pair of substantially parallel slits; and forming a second pair of substantially parallel slits, each substantially perpendicular to the first pair of slits and nonintersecting with the first pair of slits.

44. The method of claim 43, further comprising forming the second pair of slits to extend a predetermined length past the first pair of slits.

45. The method of claim 44, further comprising forming the predetermined length of the second pair of slits extending past the first pair of slits to accommodate a difference in level between the first seal and the at least one other seal.

* * * * *